United States Patent [19]

Shisler et al.

[11] 4,376,273

[45] Mar. 8, 1983

[54] TELEVISION DEFLECTION YOKE HAVING A TOROIDALLY-WOUND DEFLECTION COIL

[75] Inventors: Robert W. Shisler, Noblesville, Ind.; William H. Barkow, Pennsauken, N.J.

[73] Assignee: RCA Corporation, New York, N.Y.

[21] Appl. No.: 286,377

[22] Filed: Jul. 24, 1981

[51] Int. Cl.[3] ..... H01H 1/00

[52] U.S. Cl. ..... 335/213; 335/210

[58] Field of Search ..... 335/210, 213, 212

[56] References Cited

U.S. PATENT DOCUMENTS 3,996,542 12/1976 Barkow ..... 335/213
4,023,129 5/1977 Kratz et al. ..... 335/210
4,117,432 9/1978 Shizu ..... 335/210
4,228,413 10/1980 Campbell et al. ..... 335/213
4,316,166 2/1982 Simmons et al. ..... 335/213

*Primary Examiner*—George Harris
*Attorney, Agent, or Firm*—Paul J. Rasmussen; William H. Meise; Scott J. Stevens

[57] ABSTRACT

A deflection yoke for a television receiver comprises a toroidally wound vertical deflection coil. The coil is wound with successive active conductor windings alternately disposed adjacent to two horizontal deflection return flux paths to eliminate induced voltage buildup in the vertical coils from the horizontal return flux. The coil may be wound with a double bias configuration to permit correction of vertical coma errors and side pincushion raster distortion.

5 Claims, 5 Drawing Figures

TELEVISION DEFLECTION YOKE HAVING A TOROIDALLY-WOUND DEFLECTION COIL

This invention relates to deflection yokes for television receivers and in particular to yokes having toroidally-wound vertical deflection coils.

The picture tube or kinescope of a color television receiver produces three electron beams which are deflected or scanned across a phosphor display screen to form a raster. Deflection of the beams is caused by electromagnetic fields produced by the coils of a deflection yoke located on the neck of the tube.

In order to prevent color fringing, it is important that the electron beams converge at all locations on the display screen. This may be accomplished by dynamic convergence circuitry which electrically modifies the deflection fields but such circuits add to the cost and complexity of the receiver. With picture tubes having the electron beams produced in a horizontal in-line configuration, it is possible to manufacture a deflection yoke which can substantially converge the beams without dynamic convergence circuitry. These self-converging yokes produce nonuniform deflection fields which influence the spatially separated electron beams differently in order to converge them in the plane of the display screen.

Generally, it is known that the horizontal deflection field must have an overall net pincushion shape, and the vertical deflection field an overall net barrel shape in order to achieve beam convergence. However, the localized field nonuniformity at particular locations along the yoke longitudinal axis may either reduce or aggravate certain misconvergence or raster distortion conditions, such as vertical coma error and side pincushion distortion. For example, vertical coma error of the type where the center beam raster is reduced in height with respect to the outer beam rasters may be corrected by a pincushion shaped vertical deflection field near the beam-entrance region or rear of the yoke. Side pincushion raster distortion may be corrected by a pincushion shaped vertical deflection field near the beam-exit region or front of the yoke. These pincushion correcting fields are in opposition to the vertical deflection field nonuniformity needed for convergence of the electron beams, as previously described. It is possible to make the pincushion nonuniformity sufficiently localized so that the desired correction takes place but the overall net nonuniformity of the vertical deflection field remains barrel-shaped.

One technique to achieve localized field nonuniformity variations is through the use of external field modifiers for magnetically permeable material mounted within either the main or stray deflection fields of the yoke in order to shape or modify the existing field to produce a field having the desired nonuniformity at the desired location. This technique may increase the cost and complexity of the yoke-tube combination considerably. Reducing the size of the external field formers as a means of reducing yoke manufacturing costs can also lead to problems. For example, the field formers may be too small to provide sufficient correction. Also, the field formers may become saturated by the surrounding magnetic field, thereby changing the inductance seen by the driving circuitry. For certain types of driving circuits, this inductance change may cause an undesirable nonlinear change in scanning current.

A second technique for providing localized field nonuniformity is through configuration of the deflection windings themselves. With toroidally-wound vertical deflection coils, it is known that vertical coma and side pincushion distortion may be corrected through the use of non-radial or biased winding techniques. However, the correction of both coma and side pincushion distortion while still maintaining beam convergence requires a double biased winding technique in order to produce a nongeodesic coil. The difficulty in forming a toroidal nongeodesic coil involves the problem of accurately locating and securing the wires during winding. Nongeodesic coils have been wound using rings having slots or teeth for holding the wires. These rings are inserted into the core prior to winding the coil. These rings suffer the drawbacks of either being bulky and consuming a great deal of space within the core, or being small and providing little lateral support to the wire turns. A copending application entitled "Self Converging Deflection Yoke and Winding Method and Apparatus Therefor", Ser. No. 181,997 filed Aug. 28, 1980, in the names of G. A. Simmons and K. W. McGlashan, now U.S. Pat. No. 4,316,166, discloses a core insert which allows the winding of nongeodesic coil and which comprises a removable portion which forms a wire guide channel during winding. A portion of the core insert remains in place after assembly of the yoke.

With a deflection yoke having toroidally-wound vertical deflection coils and saddle-type horizontal coils, horizontal deflection return flux in the core may induce voltage in the vertical coil turns. Although the voltage induced in each turn is small, the voltage buildup for the coil will be the sum of the voltage induced in the individual turns. If the vertical coil has many turns, this induced voltage may build up to a significant level. Since the horizontal coil is desirably located symmetrically with respect to the vertical coils, the voltage buildup will reach its maximum value at the midpoint of each coil half. The voltage induced in opposite coil halves will be of opposite polarity, causing a high potential to be established between the opposite coil halves of the vertical deflection coil pair. In the event that insulation on any wire turn breaks down (perhaps due to a nicked or cut wire), the potential difference between the coils may cause a short circuit through the core to occur, thereby rendering the yoke inoperative. In order to limit the induced voltage buildup to an acceptable level, prior yoke winding techniques have wound coils having multiple layers of wire, with flyback or unidirectional windings between layers. The voltage buildup will therefore be limited to the number of turns in each layer. Although this technique reduces the maximum induced voltage level, an appreciable voltage is still induced and the potential for yoke failure due to voltage breakdown remains.

The present invention provides a deflection coil which substantially eliminates induced voltage buildup. In one embodiment, the coil is formed in a manner which provides a double bias winding configuration, permitting the manufacture of a coma and side pincushion-free self-converging deflection yoke.

In accordance with the present invention, a deflection yoke comprises a magnetically permeable core with a deflection coil toroidally disposed on the core. The coil has a first active wire turn portion disposed within a first arcuate region of the core and a second active wire turn portion disposed within a second arcuate region of the core. The active portions of each succeeding wire turns are alternately disposed within the first and second arcuate regions respectively.

In the accompanying drawings, FIG. 1 is a top cross sectional view of a deflection yoke, illustrating the horizontal deflection return flux;

Figure 1:
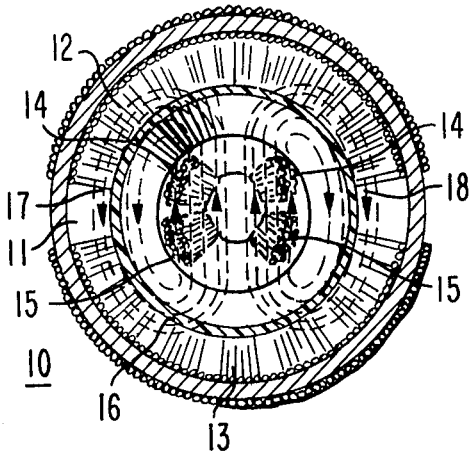

Referring to FIG. 1, there is shown a view of a yoke 10 taken in cross section. Yoke 10 comprises a magnetically permeable core 11, about which are toroidally-wound vertical deflection coils 12 and 13. Saddle type horizontal deflection coils 14 and 15 are shown separated from the vertical coils 12 and 13 by an insulator 16. The dashed lines shown in FIG. 1 represent the horizontal deflection flux lines. The portions of the dashed lines designated 17 and 18 lying outside the coils 14 and 15 represents the horizontal deflection return flux. The return flux flows through the low reluctance core 11, as shown by lines 17 and 18.

The horizontal deflection return flux flowing in core 11 induces voltage in the turns of vertical deflection coils 12 and 13. The voltage induced in each turn is small, of the order of 1 volt, but the voltage induced in all the turns will sum along the length of the coils. Therefore, a coil having a large number of turns may have a large induced voltage buildup. The maximum induced voltage level will be reached at the return flux path interfaces, i.e., the boundary between flux lines 17 and flux lines 18. Because of the return flux polarity, the voltage induced in coil 12 will be opposite in polarity to the voltage induced in coil 13, resulting in a large induced voltage potential between coils 12 and 13, e.g., of the order of 100 volts. If an insulation breakdown should occur in the wires of coil 12 or 13, the surface insulation of the core may be insufficient to prevent shorting between coils 12 and 13 through the core, thereby destroying the yoke.

Figure 2:
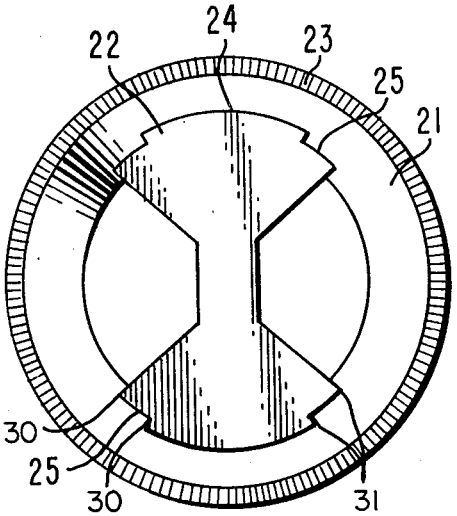
FIG. 2 is a view along the longitudinal axis of a deflection yoke core adapted for winding a deflection coil in accordance with the present invention.

FIG. 2 illustrates an arrangement for winding a toroidal vertical coil which eliminates the previously described problem of horizontal return flux induced voltage buildup. In addition, the coil wound using the arrangement of FIG. 2 will comprise a double bias winding configuration which permits the correction of vertical coma errors and side pincushion distortion by the coils themselves while still maintaining the required overall field nonuniformity necessary for electron beam convergence. FIG. 2 shows a magnetically permeable core 21 with a winding aid insert 22 in place within the interior of core 21. Insert 22 may be incorporated as part of a winding fixture or jig. To insure that insert 22 is properly placed within core 21 and that its placement is reproducible on a core-to-core basis, the interior surface of core 21 may be ground to a specified contour and dimension. Other means of maintaining the position of insert 22 may also be used. A core end ring 23 comprising a plurality of wire guides or slots is shown mounted to the front of core 21. A similar core end ring 26 (shown in FIG. 4) is mounted to the rear surface of core 21. Winding insert 22, in combination with the core end rings 23 and 26, define the winding configuration and distribution of the toroidal coils. Insert 22 comprises a window plate 24 which determines the coil window width. Channels 25 determine the active conductor distribution by controlling the packing of the wire turns. To define the coil shape to a greater degree, it is possible to use additional inserts at different locations along the core longitudinal axis.

Figure 3:
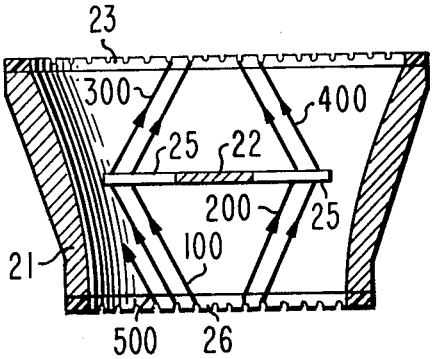
FIG. 3 is a cross sectional side elevational view of the core shown in FIG. 2 illustrating the active conductor pattern of a coil in accordance with the present invention.
Figure 4:
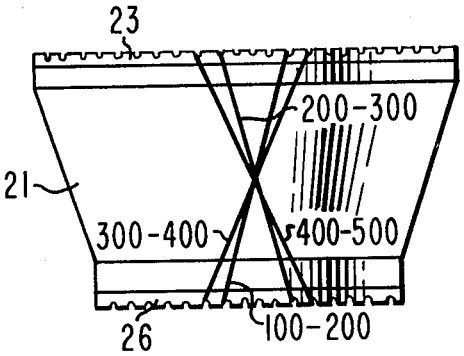
FIG. 4 is a side elevational view of the core shown in FIG. 2, illustrating the return conductor paths of the coil shown in FIG. 3.

Referring to FIGS. 3 and 4, a technique for winding a deflection coil in accordance with the present invention will be shown. FIG. 3 illustrates active conductor segments 100, 200, 300, 400 and 500 of representative wire turns wound using the arrangement of FIG. 2. Conductors 100–500 are shown spaced in a greatly exaggerated manner for clarity. In actual practice, the the conductors 100–500 would pack tightly within channels 25 of insert 22. Active conductor segments 100–500 comprise consecutively wound active conductor segments, respectively. Therefore, conductor 100 will be wound first, followed by conductors 200, 300, 400 and 500, and continuing in this manner until the entire coil is wound. It can be seen in FIG. 3 that consecutive active conductor segments are alternately disposed on opposite sides of window plate 24 within different arcuate regions of the core 21. These arcuate regions, designated 30 and 31, are shown in FIG. 2. Therefore, alternate active conductor segments will be disposed within different horizontal deflection return flux paths. This causes the voltage induced in each wire turn to be cancelled by the voltage induced in the succeeding wire turn. It is of course possible to wind several consecutive wire turns with active conductor segments in the same return flux path, then wind several turns with active conductors in the other return flux path to form active conductor turn groups. This permits only a small induced voltage buildup in a limited number of turns, which may be satisfactory.

FIG. 4 shows the return conductor paths lying along the outside of the core necessary to permit the winding shown in FIG. 3. It can be seen in FIG. 4 that consecutive return conductors cross over the previously wound return conductor. The numerical designation of conductors in FIG. 4 represents the return conductor joining the designated active conductor shown in FIG. 3.

Figure 5:
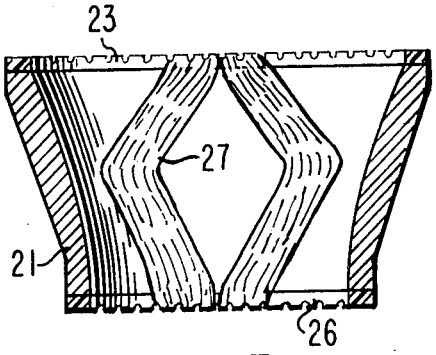
FIG. 5 is a cross sectional side elevational view of a deflection yoke illustrating a deflection coil in accordance with the present invention.

FIG. 5 illustrates a representative completed deflection coil half 27 wound in accordance with the present invention using the arrangement shown in FIG. 2. The double bias winding configuration is apparent. An identical winding on the other half of the yoke core makes up the completed toroidally wound deflection coil.

Of course, other active winding distributions are also possible, such as single bias or planar-wound coils.

What is claimed is:

1. A deflection yoke comprising:

a magnetically permeable core; and a deflection coil, comprising a plurality of wire turns toroidally disposed on said core, said coil having a pair of coil halves, each of said coil halves comprising first and second winding segments occupying first and second arcuate regions of said core surface, each of said coil halves being wound on said core such that active portions of succeeding wire turns are disposed alternately within said first and second arcuate regions of said core surface.

2. A deflection yoke for use in a television receiver comprising:

a pair of saddle-type horizontal deflection coils, each of said coils comprising first and second active conductor winding segments;

a magnetically permeable core encircling said horizontal deflection coils, said core providing first and second flux return paths adjacent said first and second active conductor winding segments; and a pair of vertical deflection coils, toroidally disposed on said core, each of said coils comprising a plurality of winding turns each having an active conductor winding portion, the active conductor winding portions of successive winding turns being alternately disposed adjacent said first and second flux return paths, respectively, to provide a reduction in the voltage level induced in said vertical deflection coils from said horizontal deflection coils.

3. A deflection yoke, comprising:

a magnetically permeable core; and a deflection coil toroidally disposed about said core, said coil being formed of a plurality of toroidal conductor turn groups comprising active conductor turn groups and flux return turn groups, said coil having a first active conductor turn group disposed within a first arcuate region of said core, a second active conductor turn group disposed within a second arcuate region of said core, and active turn groups of succeeding conductor turn groups alternately disposed within said first and second arcuate regions of said core, each of said conductor turn groups being formed from a predetermined small number of conductor turns.

4. A yoke according to claim 3 wherein said predetermined small number is one.

5. A method for winding a deflection coil be toroidally disposed on a magnetically permeable core of a deflection yoke, comprising the steps of:

forming a first active conductor turn group;

placing said first active conductor turn group on said core within a first arcuate region of said core;

forming and placing a second active conductor turn group on said core within a second arcuate region of said core; and forming and placing succeeding active conductor turn groups on said core alternately within said first and second arcuate regions of said core such that succeeding flux return turn groups joining said active conductor turn groups overlap on the outside of said core.

* * * * *

UNITED STATES PATENT AND TRADEMARK OFFICE
CERTIFICATE OF CORRECTION

PATENT NO. : 4,376,273

DATED : March 8, 1983

INVENTOR(S) : Robert W. Shisler & William H. Barkow

It is certified that error appears in the above-identified patent and that said Letters Patent is hereby corrected as shown below:

Col. 6, line 9, following "coil" insert -- to --.

Signed and Sealed this

*Tenth* Day of *May 1983*

[SEAL]

*Attest:*

GERALD J. MOSSINGHOFF

*Attesting Officer*

*Commissioner of Patents and Trademarks*